US006861622B2

(12) United States Patent
Kakihara et al.

(10) Patent No.: US 6,861,622 B2
(45) Date of Patent: Mar. 1, 2005

(54) NEGATIVE TEMPERATURE COEFFICIENT THERMISTOR AND METHOD FOR MANUFACTURING THE SAME

(75) Inventors: Satoshi Kakihara, Omihachiman (JP); Takehiko Ishii, Moriyama (JP); Kenji Nagareda, Shiga-ken (JP); Masahiko Kawase, Yokaichi (JP); Satoshi Fujita, Kyoto (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/622,552

(22) Filed: Jul. 21, 2003

(65) Prior Publication Data

US 2004/0020918 A1 Feb. 5, 2004

(30) Foreign Application Priority Data

Jul. 25, 2002 (JP) ..... 2002-216770

(51) Int. Cl.[7] ..... H05B 1/02

(52) U.S. Cl. ..... 219/505; 219/535; 219/504; 338/22 R; 156/89.18; 156/89.12; 361/712

(58) Field of Search ..... 219/505, 504, 219/494, 535; 338/22 R; 264/614; 156/89.12, 89.16, 89.18; 361/363, 708, 712; 29/831, 830

(56) References Cited

U.S. PATENT DOCUMENTS 4,912,450 A * 3/1990 Yoneda et al. ..... 338/22 R
6,400,553 B2 * 6/2002 Yoshii et al. ..... 361/321.2
6,469,612 B2 * 10/2002 Nakayama et al. ..... 338/22 R
6,525,395 B1 * 2/2003 Kawase et al. ..... 257/528

FOREIGN PATENT DOCUMENTS

| | | |
|---|---|---|
| JP | 04-328801 | 11/1992 |
| JP | 05-021209 | 1/1993 |
| JP | 05-021210 | 1/1993 |
| JP | 08-236309 | 9/1996 |
| JP | 08-250307 | 9/1996 |
| JP | 10-233303 | 9/1998 |
| JP | 11-224804 | 8/1999 |
| JP | 11-265804 | 9/1999 |
| JP | 11-283804 | 10/1999 |

* cited by examiner

*Primary Examiner*—Mark Paschall
(74) *Attorney, Agent, or Firm*—Dickstein, Shapiro, Morin & Oshinsky, LLP.

(57) ABSTRACT

A negative temperature coefficient thermistor includes a thermistor element containing a transition metal oxide as a main component; internal electrodes disposed in the thermistor element; and external electrodes, electrically connected to the internal electrodes. A method for manufacturing such a thermistor includes providing green ceramic sheets for forming the thermistor element; applying a conductive paste for forming the internal electrodes onto some of the green ceramic sheets to form internal electrode layers; stacking the green ceramic sheets and the green ceramic sheets with the paste to form a green compact; firing the green compact to obtain a fired compact; and forming the external electrodes.

20 Claims, 4 Drawing Sheets

NEGATIVE TEMPERATURE COEFFICIENT THERMISTOR AND METHOD FOR MANUFACTURING THE SAME

BACKGROUND OF THE INVENTION

1. Field of the Invention

The present invention relates to negative temperature coefficient thermistors (hereinafter referred to as NTC thermistors), and particularly relates to a multilayer NTC thermistor including internal electrodes and a method for manufacturing such a thermistor.

2. Description of the Related Art

Demands have been made for NTC thermistors, intended for temperature sensors and temperature compensators, having low resistance. To achieve that, the following technique, for example, is disclosed in Japanese Unexamined Patent Application Publication No. 4-328801: Cu is added to an NTC thermistor element comprising a sintered body of a spinel metal oxide containing Mn, Co, Ni, and so on, thereby reducing the resistivity.

The following technique is disclosed in Japanese Patent No. 3218906: an external electrode material containing Cu is applied to end faces of an NTC thermistor element and a Cu component contained in electrodes is localized at the interface between each electrode and the element to reduce the resistivity.

These conventional techniques are intended for lead-type NTC thermistors. When the techniques are used for chip-type NTC thermistors, problems arise.

In Japanese Unexamined Patent Application Publication No. 4-328801, as shown in FIG. 1, a first NTC thermistor 1 includes a first NTC thermistor element 2 and first external electrodes 3, disposed on both ends of the first NTC thermistor element 2. When a ceramic composition containing Cu is used for forming the first NTC thermistor element 2, the first NTC thermistor element 2 uniformly contains Cu and thus the entire first NTC thermistor element 2 has low resistivity. Therefore, there is a problem in that a metal coating is formed on the first NTC thermistor element 2 when metal coatings are each formed on corresponding first external electrodes 3 by an electrolytic plating process.

In Japanese Patent No. 3218906, as shown in FIG. 2, a second NTC thermistor 11 includes a second NTC thermistor element 12, having a chip shape, and second external electrodes 13. When Cu is added to an electrode-forming material such that Cu migrates from electrodes to the second NTC thermistor element 12 by diffusion, formed are regions A of the second NTC thermistor element 12 having a resistivity smaller than that of other regions, regions A being adjacent to the second external electrodes 13. Therefore, there is a problem in that a metal coating is formed on the second NTC thermistor element 12 when the electrode-forming material containing Cu is applied to both ends of the NTC thermistor element 12, the second external electrodes 13 are formed by firing the resulting material, and metal coatings are then formed on the corresponding second external electrodes 13 by an electrolytic plating process. This is because regions a of the second NTC thermistor element 12 function as cores from which coatings grow to form the metal coating.

In order to solve the above problems of the conventional techniques, the following chip-type thermistor has been proposed, as shown in FIG. 3: a third NTC thermistor 21 including a third NTC thermistor element 21, third internal electrodes 24 disposed in the third NTC thermistor element 22, and third external electrodes 23 disposed at both ends of the third NTC thermistor element 22 and electrically connected to the third internal electrodes 24. However, even if a material for forming the third external electrodes 23 contains Cu, the quantity of diffused Cu is insufficient to control the resistance although Cu is diffused in the third NTC thermistor element 22 from the third internal electrodes 24. Thus, the resistance of the third NTC thermistor 21 cannot be sufficiently decreased.

SUMMARY OF THE INVENTION

It is an object of the present invention to provide an NTC thermistor including internal electrodes and having lower resistance and a method for manufacturing such a thermistor, wherein the thermistor can be subjected electrolytic plating without forming a metal coating on a thermistor element.

In a first aspect of the present invention, an NTC thermistor includes a thermistor element containing a transition metal oxide as a main component; internal electrodes disposed in the thermistor element; and external electrodes, electrically connected to the internal electrodes, each lying on corresponding ends of the thermistor element, wherein the internal electrodes contain a metal component other than Cu as a main component and at least one of Cu and Cu compounds as a sub-component.

In the NTC thermistor, the external electrodes contain a metal component other than Cu as a main component and at least one of Cu and Cu compounds as a sub-component.

The transition metal oxide contained in the thermistor element is preferably at least one selected from the group consisting of Mn, Ni, Co and Fe. The content of the transition metal oxide is preferably about 80 to 100%.

The material for forming the internal electrodes preferably contains at least one selected from the group consisting of Ag, Pd and Pt as a main component. The content of the main component is preferably about 84 to 96%. The content of Cu is preferably about 4 to 16%.

The material for forming the external electrodes preferably contains at least one selected from the group consisting of Ag, Pd and Pt as a main component. The content of the main component is preferably about 84 to 96%. The content of Cu is preferably about 4 to 16%.

In a second aspect of the present invention, a method for manufacturing an NTC thermistor includes a first step of preparing green ceramic sheets containing a transition metal oxide as a main component, for forming a thermistor element; a second step of applying a conductive paste containing a metal component other than Cu as a main component and at least one of Cu and Cu compounds, for forming internal electrodes on some of the green ceramic sheets to form layers for forming the internal electrodes; a third step of stacking the green ceramic sheets prepared in the first step and the paste-applied green ceramic sheets prepared in the second step in an arbitrary manner to form a green compact having opposed planes; a fourth step of firing the green compact to obtain a fired compact; and a fifth step of forming external electrodes on both ends of the fired compact by a firing process, wherein the fourth step includes a firing sub-step of firing the green compact at a maximum temperature of about 1,000 to 1,350° C. in an atmosphere containing about 20 to 80% of oxygen and a cooling sub-step of cooling the fired compact at a cooling rate of about 100 to 300° C./h after the firing sub-step.

In the above method, the external electrodes formed in the fifth step contain a metal component other than Cu as a main component and at least one of Cu and Cu compounds.

In the above method, the cooling sub-step of the fourth step includes an operation of cooling the fired compact to about 800 to 1,100° C. and an operation of holding the resulting compact at about 800 to 1,100° C. for about 60 to 600 minutes and then further cooling the resulting compact.

In the present invention, Cu can be diffused in the entire thermistor element, except for the vicinity of the surface thereof, from the internal electrodes since the internal electrodes contain at least one of Cu and Cu compounds. Thereby, the resistance of the NTC thermistor can be decreased.

Since Cu is not diffused in the vicinity of the surface of the thermistor element, the resistance of the surface vicinity is not decreased, thereby preventing a metal coating from being formed on the thermistor element.

The quantity of diffused Cu can be precisely adjusted by controlling the heating and cooling mode and the oxygen content in a furnace during firing. Thus, for the NTC thermistor element having a certain composition, the resistance and the B constant can be adjusted in a wide range.

DESCRIPTION OF THE PREFERRED EMBODIMENTS

First Embodiment

A first embodiment of the present invention will now be described.

Figure 4:
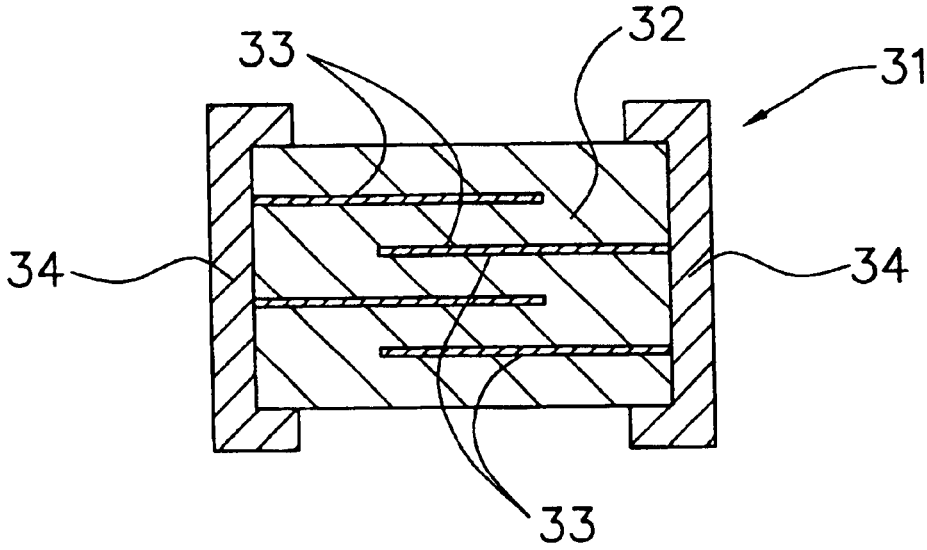
FIG. 4 is a sectional view showing an NTC thermistor according to the present invention.

FIG. 4 is a sectional view showing a fourth NTC thermistor 31 according to the first embodiment of the present invention.

The fourth NTC thermistor 31 includes a fourth NTC thermistor element 32, fourth internal electrodes 33 disposed in the fourth NTC thermistor element 32, and fourth external electrodes 34 each disposed at the corresponding end faces of the fourth NTC thermistor element 32 and electrically connected to the corresponding fourth internal electrodes 33.

The material for forming the fourth internal electrodes 33 contains Cu, which is diffused in the vicinities of the fourth internal electrodes 33. Thus, the inner part has a resistivity smaller than that of the surface in the fourth NTC thermistor element 32.

EXAMPLE 1

Example 1 will now be described with reference to FIG. 4. A fourth NTC thermistor 31 of Example 1 has the same configuration as that of the first embodiment. In this example, the same components as those used in the first embodiment have the same reference numerals as those in the first embodiment.

The fourth NTC thermistor 31 of Example 1 was prepared according to the following procedure: an organic binder, a dispersant, an anti-foaming agent, and water were added to a thermistor material containing 80% by weight of $Mn_3O_4$ and 20% by weight of NiO, thereby preparing a plurality of green ceramic sheets having a thickness of 40 $\mu$m.

A conductive paste containing an electrode material for forming fourth internal electrodes 33 was provided on some of the green ceramic sheets by a printing process and the resulting green ceramic sheets, which are referred to as first green ceramic sheets and the other green ceramic sheets having no conductive paste thereon are referred to as second green ceramic sheets, were then dried. The conductive paste is preferably prepared according to the following procedure: metal powder containing 63% by weight of Ag, 27% by weight of Pd and 10% by weight of Cu is prepared and then mixed with an organic solvent.

The first green ceramic sheets each having the conductive paste for forming fourth internal electrodes 33 and the second green ceramic sheets were stacked and pressed. The pressed green ceramic sheets were then cut into pieces having a chip size, thereby obtaining green compacts for forming fourth NTC thermistor element 32.

Each green compact was fired at a maximum temperature of 1,200° C. in a furnace, thereby obtaining the NTC thermistor element 32 (sintered compact). In this procedure, the oxygen content in the furnace was 20% and the sintered compact was cooled from the maximum temperature to room temperature at a cooling rate of 200° C./h.

A paste for forming fourth external electrodes 34 was applied onto both ends of the sintered compact and then fired, thereby forming the fourth external electrodes 34. This paste contained 90% by weight of Ag and 10% by weight of Pd. In this procedure, the firing temperature was 850° C. and the oxygen content in the furnace was 20%. The resulting sintered compact was then subjected to electrolytic plating, whereby a metal coating consisting of an Ni layer and an Sn layer disposed thereon was formed on each fourth external electrode 34. Thereby, the fourth NTC thermistor 31 was obtained.

For the fourth NTC thermistor 31, the following characteristics are shown in Table 1: the Cu content in the internal electrodes, the resistance, the difference in resistance, the B constant, the difference in B constant, and the change in resistance.

Second Embodiment

A second embodiment of the present invention will now be described with reference to FIG. 4. The fourth NTC thermistor 31 of a second embodiment has the same configuration as that of the first embodiment. In this embodiment, the same components as those used in the first embodiment have the same reference numerals as those in the first embodiment.

In the fourth NTC thermistor 31 of the second embodiment, a material for forming fourth internal electrodes 33 and a material for forming fourth external electrodes 34 both contain Cu, which is diffused in regions of a fourth NTC thermistor element 32 adjacent to the fourth internal electrodes 33. Thus, in the fourth NTC thermistor element 32, the inner part has a resistivity smaller than that of the surface region.

Cu contained in the material for forming the fourth external electrodes 34 is diffused in regions of the fourth NTC thermistor element 32 adjacent to the fourth internal electrodes 33 from the fourth internal electrodes 33 when the external electrode material is fired.

EXAMPLE 2

Example 2 will now be described with reference to FIG. 4. The fourth NTC thermistor 31 of Example 2 has the same configuration as that of the first embodiment. In this example, the same components as those used in the first embodiment have the same reference numerals as those in the first embodiment.

The fourth NTC thermistor 31 of Example 2 including fourth NTC thermistor element 32 (sintered compact) was prepared according to the same procedure as that for preparing the fourth NTC thermistor 31 of Example 1, except for the following procedure: an external electrode material containing 80% by weight of Ag, 10% by weight of Pd and 10% by weight of Cu was applied to both ends of fourth NTC thermistor element 32.

For the fourth NTC thermistor 31 of the Example 2, the following characteristics are shown in Table 1: the Cu content in the internal electrodes, the resistance, the difference in resistance, the B constant, the difference in B constant, and the change in resistance.

Comparative Example 1

Figure 1:
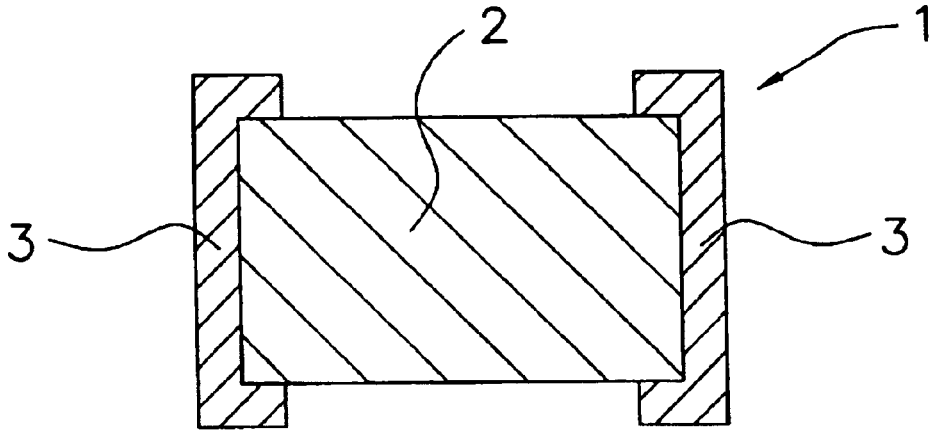
FIG. 1 (PRIOR ART)
FIG. 1 is a sectional view showing a conventional NTC thermistor.
Figure 2:
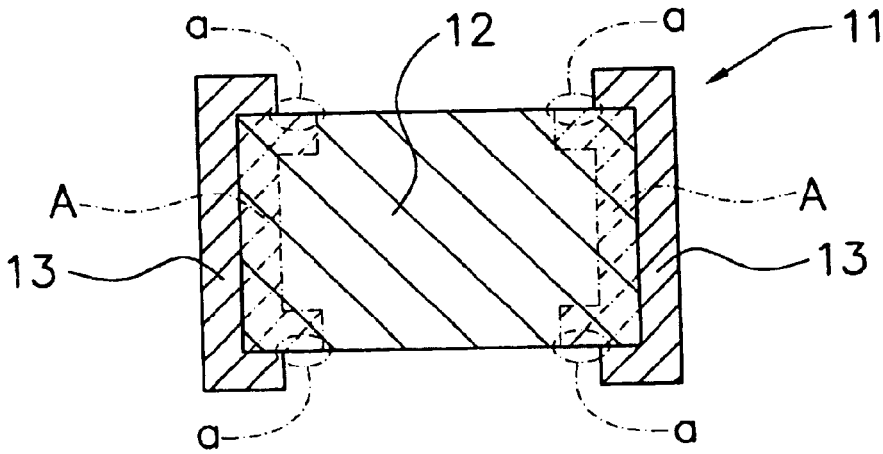
FIG. 2 (PRIOR ART)
FIG. 2 is a sectional view showing another conventional NTC thermistor.

In Comparative Example 1, a second NTC thermistor 11 including no internal electrodes was prepared, wherein this thermistor is a conventional one shown in FIG. 2. The Cu content in the paste for forming second external electrodes 13 was 10% by weight. For the second NTC thermistor 11, the resistance, the difference in resistance, the B constant, the difference in B constant, and the change in resistance were measured in the same manner as those of Examples 1 and 2. The obtained measurements are shown in Table 1.

Comparative Example 2

Figure 3:
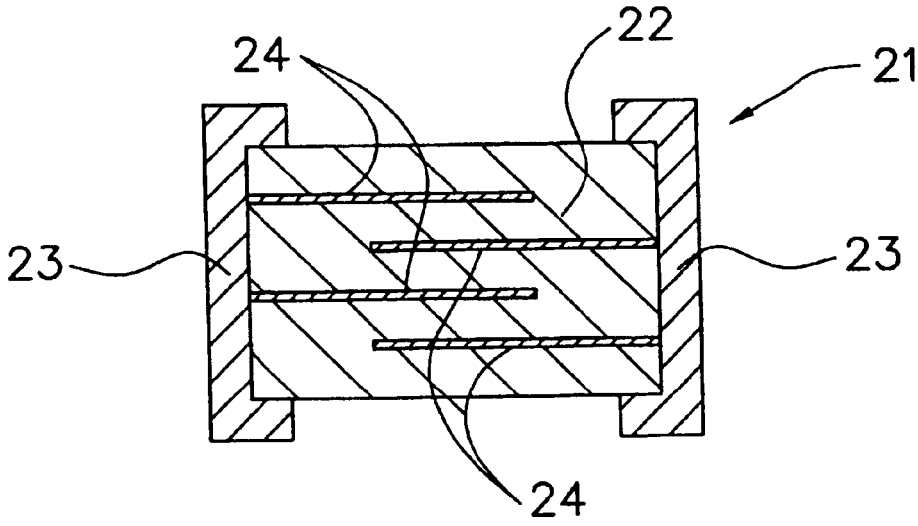
FIG. 3 (PRIOR ART)
FIG. 3 is a sectional view showing another conventional NTC thermistor.

In Comparative Example 2, a third NTC thermistor 21 including third external electrodes 34 containing Cu was prepared, wherein this thermistor is a conventional one shown in FIG. 3. The Cu content in a paste for forming the external electrodes was 10% by weight. For the third NTC thermistor 21, the resistance, the difference in resistance, the B constant, the difference in B constant, and the change in resistance were measured in the same manner as those of Examples 1 and 2. The obtained measurements are shown in Table 1.

TABLE 1

| | Cu Content in Internal Electrodes (weight %) | Cu Content in External Electrodes (weight %) | Cu Content in Internal Electrodes after Diffusion (atomic %) | Resistance (R25) (Ω) | Difference in Resistance (%) | B Constant (K) | Difference in B Constant (3CV) (%) | Change in Resistance after High-temperature Treatment (R25) (%) |
|---|---|---|---|---|---|---|---|---|
| Example 1 | 10 | 0 | 11.5 | 996 | 7.6 | 3430 | 0.5 | 0.5 |
| Example 2 | 10 | 10 | 12.5 | 884 | 7.2 | 3420 | 0.6 | 0.6 |
| Comparative Example 1 | — | 10 | — | 1200 | 14.1 | 3472 | 1.3 | 3.6 |
| Comparative Example 2 | 0 | 10 | 2.1 | 1100 | 12.3 | 3465 | 1.2 | 3.2 |

As shown in Table 1, the second NTC thermistor 11 including no internal electrodes (Comparative Example 1), has a resistance which is not sufficiently decreased even if the external electrode-forming material contains Cu. This is because the diffusion of Cu is limited within regions A adjacent to the second external electrodes 13 while the external electrodes 13 are formed by a firing process.

The resistance is not sufficiently decreased even if the external electrode-forming material only contains Cu in the third NTC thermistor 21 including the third internal electrodes 24 (Comparative Example 2). This is because the quantity of diffused Cu is insufficient although Cu is diffused in the inner part of the third NTC thermistor element 22 from the third external electrodes 23 via the third internal electrodes 24 while the external electrodes 23 are formed by a firing process.

In contrast, the resistance can be sufficiently decreased in Example 1 using the fourth NTC thermistor 31 including the fourth internal electrodes 33 containing Cu. This is because Cu can be diffused in the entire fourth NTC thermistor element 32, except for the surface region thereof, from the fourth internal electrodes 33 during firing, thereby sufficiently increasing the quantity of diffused Cu.

Since Cu-diffused layers are formed in the vicinities of the fourth internal electrodes 33, the fourth internal electrodes 33 are chemically joined to the fourth NTC thermistor element 32, thereby enhancing the bonding strength between the metal material and the ceramic material. Since a plurality of the fourth internal electrodes 33 are disposed in the fourth NTC thermistor element 32, the gradient of the Cu content in the fourth NTC thermistor element 32 is decreased, thereby reducing the resistance, the difference in B constant, and time-lapse changes in resistance.

In Example 2, the internal electrode-forming material and the external electrode-forming material used for preparing the fourth NTC thermistor 31, both contain Cu. Therefore, Cu can be diffused in the entire fourth NTC thermistor element 32, except for the surface region thereof, from the fourth internal electrodes 33 not only during the firing of the fourth NTC thermistor element 32 but also during the formation of the fourth external electrodes 34 by a firing process. Thus, the resistance can be further lowered as compared with Example 1.

The thickness of a metal coating on a thermistor element is shown in Table 2 for Example 1 and Comparative Example 1. This measurement was performed according to the following procedure: external electrodes were formed on an NTC thermistor element by a firing process, and the resulting NTC thermistor element was then subjected to electrolytic plating, whereby metal coatings consisting of an Ni layer and an Sn layer disposed thereon were each formed on the corresponding external electrodes, wherein the Cu content in a material for forming the internal electrodes and a material for forming the external electrodes was varied such that the thickness of the metal coating formed on the thermistor element was varied.

TABLE 2

| | Cu Content in internal electrodes (weight %) | Cu Content in external electrodes (weight %) | Thickness of Metal Coating on Thermistor Element (μm) |
|---|---|---|---|
| Example 1 | 4 | 0 | 0 |
| | 8 | 0 | 0 |
| | 16 | 0 | 0 |
| Comparative | — | 0 | 0 |
| Example 1 | — | 4 | 12 |
| | — | 8 | 16 |
| | — | 16 | 18 |

As shown in Table 2, the second NTC thermistor 11 including no internal electrodes, Comparative Example 1, has metal coating formed on the second NTC thermistor element 12 even if the external electrode-forming material contains Cu. This is because Cu-diffused layers are formed in regions A of the second NTC thermistor element 12 adjacent to the second external electrodes 13 and therefore these regions have a resistivity smaller than that of other regions, whereby such a metal coating is formed on the second NTC thermistor element 12. For this phenomenon, it is presumed that regions a of the surface of the second NTC thermistor element 12 function as cores from which coatings grow to form the metal coating.

In contrast, the internal electrode-forming material in Example 1, used for preparing the fourth NTC thermistor 31 including the internal electrodes, contains Cu. Therefore, Cu is diffused in the entire fourth NTC thermistor element 32, except for the surface thereof and the vicinity, from the fourth internal electrodes 33, whereby the resistivity of the inner part of the NTC thermistor element 32 is lowered.

Thus, the resistivity of the surface is larger than that of the inner part in the fourth NTC thermistor element 32, whereby the metal coating can be prevented from being formed on the fourth NTC thermistor element 32.

EXAMPLE 3

Samples were prepared according to the same procedure as that for preparing the fourth NTC thermistor 31 of Example 1 except for the following conditions.

(1) The temperature of firing a green compact for forming the fourth NTC thermistor element 32

(2) The oxygen content in the furnace (3) The cooling rate in a cooling sub-step of a firing step Particular conditions are shown in Table 3.

TABLE 3

| Samples | Firing Temperature (° C.) | Oxygen Content in Furnace (%) | Cooling Rate (° C./h) | Remarks |
|---|---|---|---|---|
| 1 | 950 | 20 | 200 | The firing temperature is varied. |
| 2 | 1000 | 20 | 200 | |
| 3 | 1100 | 20 | 200 | |
| 4 | 1350 | 20 | 200 | |
| 5 | 1370 | 20 | 200 | |
| 6 | 1100 | 10 | 200 | The oxygen content is varied. |
| 7*1 | 1100 | 20 | 200 | |
| 8 | 1100 | 50 | 200 | |
| 9 | 1100 | 80 | 200 | |
| 10 | 1100 | 90 | 200 | |
| 11 | 1100 | 20 | 50 | The cooling rate is varied. |
| 12 | 1100 | 20 | 100 | |
| 13*1 | 1100 | 20 | 200 | |
| 14 | 1100 | 20 | 300 | |
| 15 | 1100 | 20 | 350 | |

*1The conditions of Samples 7 and 13 are the same as those of Sample 3.

For the samples prepared under the conditions shown in Table 3, the following characteristics were measured: the Cu content in the internal electrodes, the resistance, the difference in resistance, the B constant, the difference in B constant, and the change in resistance. Obtained measurements are shown in Table 4.

TABLE 4

| Samples | Cu content in Internal Electrodes after Diffusion (atomic %) | Resistance (R25) (Ω) | Difference in Resistance 3CV (%) | B constant (K) | Difference in B Constant 3CV (%) | Change in Resistance after High-temperature Treatment (%) |
|---|---|---|---|---|---|---|
| 1 | 16 | 437 | 12 | 3642 | 1.2 | 4.3 |
| 2 | 13 | 138 | 5 | 3268 | 0.5 | 1.6 |
| 3 | 12 | 68 | 4 | 3209 | 0.4 | 1.5 |
| 4 | 11 | 189 | 6 | 3358 | 0.5 | 1.5 |
| 5 | 10 | 487 | 18 | 3668 | 2.2 | 6.7 |
| 6 | 14 | 447 | 13 | 3612 | 1.6 | 3.3 |
| 7 | 13 | 138 | 5 | 3268 | 0.5 | 1.6 |
| 8 | 13 | 79 | 4 | 3246 | 0.3 | 1.2 |
| 9 | 15 | 218 | 6 | 3367 | 0.4 | 1.4 |
| 10 | 16 | 401 | 10 | 3602 | 1.6 | 3.7 |
| 11 | 16 | 388 | 11 | 3579 | 1.5 | 3.8 |
| 12 | 13 | 102 | 4 | 3287 | 0.4 | 1.6 |
| 13 | 13 | 138 | 5 | 3268 | 0.5 | 1.6 |
| 14 | 15 | 244 | 5 | 3398 | 0.4 | 1.7 |
| 15 | 15 | 374 | 10 | 3525 | 1.3 | 3.8 |

EXAMPLE 4

Samples were prepared according to the same procedure as that for preparing the fourth NTC thermistor 31 of Example 2 except for the following conditions.

(1) The temperature of firing a green compact for forming the fourth NTC thermistor element 32

(2) The oxygen content in the furnace (3) The cooling rate in a cooling sub-step of a firing step Particular conditions are shown in Table 5.

TABLE 5

| Samples | Firing Temperature (° C.) | Oxygen Content in Furnace (%) | Cooling Rate (° C./h) | Remarks |
|---|---|---|---|---|
| 1A | 950 | 20 | 200 | The firing temperature is varied. |
| 2A | 1000 | 20 | 200 | |
| 3A | 1100 | 20 | 200 | |
| 4A | 1350 | 20 | 200 | |
| 5A | 1370 | 20 | 200 | |
| 6A | 1100 | 10 | 200 | |
| 7A*1 | 1100 | 20 | 200 | The oxygen content is varied. |
| 8A | 1100 | 50 | 200 | |
| 9A | 1100 | 80 | 200 | |
| 10A | 1100 | 90 | 200 | |
| 11A | 1100 | 20 | 50 | The cooling rate is varied. |
| 12A | 1100 | 20 | 100 | |
| 13A*1 | 1100 | 20 | 200 | |
| 14A | 1100 | 20 | 300 | |
| 15A | 1100 | 20 | 350 | |

*1The conditions of Samples 7A and 13A are the same as those of Sample 3A.

For the samples prepared under the conditions shown in Table 5, the following characteristics were measured: the Cu content in the internal electrodes, the resistance, the difference in resistance, the B constant, the difference in B constant, and the change in resistance. In the above manufacturing procedure, an internal electrode-forming paste and external electrode-forming paste both containing 16% by weight of Cu were used. Obtained measurements are shown in Table 6.

TABLE 6

| Samples | Cu content in Internal Electrodes after Diffusion (atomic %) | Resistance (R25) (Ω) | Difference in Resistance 3CV (%) | B constant (K) | Difference in B Constant 3CV (%) | Change in Resistance after High-temperature Treatment (%) |
|---|---|---|---|---|---|---|
| 1A | 16 | 411 | 10 | 3611 | 1.2 | 4.5 |
| 2A | 13 | 127 | 4 | 3208 | 0.5 | 1.4 |
| 3A | 12 | 65 | 3 | 3168 | 0.3 | 1.3 |
| 4A | 11 | 184 | 5 | 3312 | 0.4 | 1.4 |
| 5A | 12 | 470 | 16 | 3647 | 2.0 | 4.8 |
| 6A | 15 | 402 | 14 | 3598 | 1.4 | 3.6 |
| 7A | 13 | 118 | 4 | 3244 | 0.4 | 1.4 |
| 8A | 13 | 74 | 3 | 3211 | 0.2 | 1.3 |
| 9A | 14 | 199 | 4 | 3254 | 0.3 | 1.3 |
| 10A | 16 | 388 | 9 | 3578 | 1.3 | 3.5 |
| 11A | 16 | 354 | 10 | 3570 | 1.6 | 3.4 |
| 12A | 13 | 89 | 5 | 3574 | 0.3 | 1.2 |
| 13A | 14 | 118 | 4 | 3249 | 0.4 | 1.4 |
| 14A | 15 | 213 | 5 | 3381 | 0.4 | 1.4 |
| 15A | 16 | 346 | 9 | 3504 | 1.2 | 3.7 |

EXAMPLE 5

Samples were prepared according to the same procedure as that for manufacturing the fourth NTC thermistor 31 of Example 1 except for the following procedure.

Green compacts for preparing the fourth NTC thermistor element 32 were fired at a maximum temperature of 1,200° C. in an atmosphere containing 20% of oxygen in a furnace. The resulting compacts were cooled from the maximum temperature to the temperature shown in Table 7 at a cooling rate of 200° C./h and then held at the temperature for a time shown in Table 7. After the predetermined time passed, the resulting compacts were cooled to room temperature at a cooling rate of 200° C./h, thereby obtaining fired compacts for forming the fourth NTC thermistor element 32.

TABLE 7

| Samples | Cooling Temperature (° C.) | Cooling hold time (min) | Remarks Remarks |
|---|---|---|---|
| 16 | 750 | 240 | The cooling temperature is varied. |
| 17 | 800 | 240 | |
| 18 | 900 | 240 | |
| 19 | 1000 | 240 | |
| 20 | 1100 | 240 | |
| 21 | 1150 | 240 | |
| 22 | 1000 | 30 | The cooling hold time is varied. |
| 23 | 1000 | 60 | |
| 24*1 | 1000 | 240 | |
| 25 | 1000 | 600 | |
| 26 | 1000 | 700 | |

*1The conditions of Sample 24 are the same as those of Sample 19.

For the obtained samples, the following characteristics were measured: the Cu content in the internal electrodes, the resistance, the difference in resistance, the B constant, the difference in B constant, and the change in resistance. Obtained measurements are shown in Table 8.

TABLE 8

| Samples | Cu content in Internal Electrodes after Diffusion (atomic %) | Resistance (R25) (Ω) | Difference in Resistance 3CV (%) | B constant (K) | Difference in B Constant 3CV (%) | Change in Resistance after High-temperature Treatment (%) |
|---|---|---|---|---|---|---|
| 16 | 14 | 388 | 12 | 3554 | 1.2 | 3.3 |
| 17 | 14 | 245 | 4 | 3398 | 0.3 | 1.4 |
| 18 | 14 | 207 | 6 | 3367 | 0.4 | 1.6 |
| 19 | 13 | 187 | 5 | 3366 | 0.4 | 1.6 |
| 20 | 14 | 237 | 5 | 3368 | 0.5 | 1.5 |
| 21 | 16 | 337 | 11 | 3501 | 1.3 | 2.7 |
| 22 | 14 | 465 | 10 | 3599 | 1.7 | 2.9 |
| 23 | 14 | 213 | 4 | 3367 | 0.3 | 1.4 |
| 24 | 13 | 187 | 5 | 3366 | 0.4 | 1.6 |
| 25 | 15 | 223 | 4 | 3387 | 0.3 | 1.3 |
| 26 | 16 | 512 | 12 | 3613 | 1.2 | 3.1 |

EXAMPLE 6

Samples were prepared according to the same procedure as that for manufacturing the fourth NTC thermistor 31 of Example 2 except for the following procedure.

Green compacts for preparing the fourth NTC thermistor element 32 were fired at a maximum temperature of 1,200° C. in an atmosphere containing 20% of oxygen in a furnace. The resulting compacts were cooled from the maximum temperature to the temperature shown in Table 9 at a cooling rate of 200° C./h and then held at the temperature for a time shown in Table 9. After a predetermined time passed, the resulting compacts were cooled to room temperature at a cooling rate of 200° C./h, thereby obtaining fired compacts.

TABLE 9

| Samples | Cooling Temperature (° C.) | Cooling hold time (min) | Remarks Remarks |
|---|---|---|---|
| 16A | 750 | 240 | The cooling temperature is varied. |
| 17A | 800 | 240 | |
| 18A | 900 | 240 | |

TABLE 9-continued

| Samples | Cooling Temperature (° C.) | Cooling hold time (min) | Remarks Remarks |
|---|---|---|---|
| 19A | 1000 | 240 | The cooling hold time is varied. |
| 20A | 1100 | 240 | |
| 21A | 1150 | 240 | |
| 22A | 1000 | 30 | |
| 23A | 1000 | 60 | |
| 24A*[1] | 1000 | 240 | |
| 25A | 1000 | 600 | |
| 26A | 1000 | 700 | |

*[1]The conditions of Sample 24A are the same as those of Sample 19A.

For the obtained samples, the following characteristics were measured: the Cu content in the internal electrodes, the resistance, the difference in resistance, the B constant, the difference in B constant, and the change in resistance. In the above manufacturing procedure, an internal electrode-forming paste and external electrode-forming paste both containing 16% by weight of Cu were used. Obtained measurements are shown in Table 10.

TABLE 10

| Samples | Cu content in Internal Electrodes after Diffusion (atomic %) | Resistance (R25) (Ω) | Difference in Resistance 3CV (%) | B constant (K) | Difference in B Constant 3CV (%) | Change in Resistance after High-temperature Treatment (%) |
|---|---|---|---|---|---|---|
| 16A | 14 | 377 | 10 | 3539 | 1.0 | 2.7 |
| 17A | 13 | 212 | 6 | 3379 | 0.5 | 1.2 |
| 18A | 13 | 198 | 4 | 3348 | 0.3 | 1.4 |
| 19A | 14 | 168 | 5 | 3345 | 0.3 | 1.3 |
| 20A | 14 | 207 | 4 | 3341 | 0.4 | 1.3 |
| 21A | 16 | 312 | 9 | 3488 | 0.9 | 2.2 |
| 22A | 13 | 433 | 9 | 3574 | 1.3 | 2.6 |
| 23A | 14 | 198 | 6 | 3349 | 0.3 | 1.3 |
| 24A | 13 | 154 | 3 | 3351 | 0.2 | 1.3 |
| 25A | 15 | 208 | 4 | 3376 | 0.4 | 1.4 |
| 26A | 16 | 496 | 10 | 3599 | 1.1 | 2.7 |

In a method for manufacturing an NTC thermistor according to any one of Examples 3 to 6, the quantity of diffused Cu can be precisely adjusted by controlling the heating and cooling mode, the oxygen content in a furnace, and the cooling conditions while a green compact is fired, thereby adjusting the resistance and the B constant over a wide range, as shown in Tables 3 to 10. Furthermore, the difference in resistance, the difference in B constant, and the time-lapse change in resistance can be reduced, thereby enhancing the reliability.

Samples 1 to 10, which are NTC thermistors including external electrodes containing no Cu, have a small resistance, difference in resistance, difference in B constant, and time-lapse change in resistance after high-temperature treatment, as shown in Table 4. Such samples can be prepared using sintered compacts obtained by firing green compacts at a maximum temperature of 1,000 to 1,350° C. in an atmosphere containing 20 to 80% of oxygen, as shown in Table 3.

Samples 1A to 10A, which are NTC thermistors including external electrodes containing Cu, have the same advantages as those of Samples 1 to 10, as shown in Tables 5 and 6.

Samples 11 to 15, which are NTC thermistors including external electrodes containing no Cu, have a small resistance, difference in resistance, difference in B constant, and time-lapse change in resistance after high-temperature treatment, as shown in Table 4. Such samples can be prepared using sintered compacts obtained by firing green compacts under the same conditions as the above and then cooing the resulting compacts at a cooling rate of 100 to 300° C./h, as shown in Table 3.

Samples 11A to 15A, which are NTC thermistors including external electrodes containing Cu, have the same advantages as those of Samples 11 to 15, as shown in Tables 5 and 6.

Samples 16 to 26, which are NTC thermistors including external electrodes containing no Cu, have a small resistance, difference in resistance, difference in B constant, and time-lapse change in resistance after high-temperature treatment, as shown in Table 8. Such samples can be prepared using sintered compacts obtained by firing green compacts, cooling the resulting compacts to 800 to 1,100° C., maintaining the resulting compacts at such a temperature for 60 to 600 minutes, and then further cooling the resulting compacts to room temperature, as shown in Table 7.

Samples 16A to 26A, which are NTC thermistors including external electrodes containing Cu, have the same advantages as those of Samples 16 to 26, as shown in Tables 7 and 8.

The mechanism of the above phenomena is believed to be as follows.

The firing of green compacts containing ceramics for forming NTC thermistors produces a spinel phase and a halite phase. The ratio of the halite phase to the spinel phase depends on the firing temperature and the firing atmosphere.

The firing atmosphere becomes reductive when the firing temperature exceeds the above temperature range or the oxygen content in a furnace falls short of the above content range, thereby increasing the ratio of the halite phase.

Since the halite phase has an affinity to Cu, a large quantity of Cu contained in the fourth internal electrodes 33 is diffused in the fourth NTC thermistor element 32 when the ratio of the halite phase is high.

Thus, reoxidation is prevented from proceeding when the ratio of the halite phase is excessively high, whereby the spinel phase is prevented from being sufficiently formed. As a result, Cu remains in the halite phase, thereby preventing the resistance from being decreased.

In contrast, the halite phase is prevented from being formed when the firing temperature falls short of the above temperature range or the oxygen content in a furnace exceeds the above content range. Thus, Cu cannot migrate out of the fourth internal electrodes 33, thereby preventing the resistance from being decreased.

The quantity of the halite phase converted into the spinel phase, that is, the quantity of the halite phase that is reoxidized, depends on the cooling rate, the cooling hold time, and the cooling temperature. Therefore, reoxidation is prevented when the cooling rate exceeds the above rate range or the cooling hold time falls short of the above time range and the cooling temperature falls short of the above temperature range. Thereby, the resistance is prevented from being decreased.

In contrast, the degree of the reoxidation becomes excessively high when the cooling rate falls short of the above rate range or the cooling hold time exceeds the above time range and the cooling temperature exceeds the above temperature range. As a result, Cu remaining in both the original spinel phase and the spinel phase converted from the halite phase migrates back to the fourth internal electrodes 33. Thus, the Cu-diffused layers are not formed in the vicinities of the fourth internal electrodes 33, thereby preventing the resistance to be decreased.

An NTC thermistor of the present invention includes internal electrodes containing at least one of Cu and Cu compounds. Thus, such a Cu component can be diffused in an entire NTC thermistor element, except for the vicinity of the element surface, from the internal electrodes during firing. Thereby, the resistance of the NTC thermistor can be decreased.

In the vicinity of the element surface, the Cu component is not diffused and therefore the resistance is not lowered. Thus, a metal coating can be prevented from being formed on the NTC thermistor element while the NTC thermistor is subjected to electrolytic plating in order to form metal coatings on the external electrodes.

Since Cu-diffused layers are each disposed in the corresponding vicinities of the internal electrodes, the internal electrodes are chemically joined to the NTC thermistor element, that is, the bonding strength between the metal material and a ceramic material is improved. The presence of the internal electrodes lowers the effect of the diffusion distance, thereby reducing the resistance, the difference in B constant, the time-lapse change in resistance.

According to the method for manufacturing an NTC thermistor of the present invention, the quantity of diffused Cu can be precisely adjusted by controlling the heating and cooling mode and the oxygen content in a furnace during firing, the cooling rate, the cooling hold time, and the cooling time.

For an NTC thermistor element having a certain composition, the resistance and the B constant can thus be adjusted in a wide range and the difference in resistance and the difference in B constant can be reduced, thereby improving the reliability.

What is claimed is:

1. A negative temperature coefficient thermistor comprising:

a thermistor element containing a transition metal oxide as a main component;

a pair of spaced internal electrodes disposed in the thermistor element; and a pair of spaced external electrodes, each of which is electrically connected to different internal electrodes, disposed on the thermistor element, wherein the internal electrodes contain a metal component other than Cu as a main component and at least one of Cu and a Cu compound as a sub-component, and wherein the thermistor element has Cu in the vicinity of the internal electrodes.

2. The negative temperature coefficient thermistor according to claim 1, wherein the external electrodes contain a metal component other than Cu as a main component and at least one of Cu and a Cu compound as a sub-component.

3. The negative temperature coefficient thermistor according to claim 2, wherein the external electrodes contain 10 to 16 atomic % of said at least one of Cu and a Cu compound.

4. The negative temperature coefficient thermistor according to claim 3, wherein the internal electrodes contain 10 to 16 atomic % of said at least one of Cu and a Cu compound.

5. The negative temperature coefficient thermistor according to claim 4, wherein the metal component other than Cu as a main component is at least one Ag, Pd and Pt.

6. The negative temperature coefficient thermistor according to claim 5, wherein the transition metal is at least one of Mn, Ni, Co and Fe.

7. The negative temperature coefficient thermistor according to claim 6, wherein the thermistor element comprises $Mn_3O_4$ and NiO.

8. The negative temperature coefficient thermistor according to claim 1, wherein the internal electrodes contain about 10 to 16 atomic % of said at least one of Cu and a Cu compound.

9. The negative temperature coefficient thermistor according to claim 8, wherein the metal component other than Cu as a main component is at least one of Ag, Pd and Pt.

10. The negative temperature coefficient thermistor according to claim 9, wherein the transition metal is at least one of Mn, Ni, Co and Fe.

11. The negative temperature coefficient thermistor according to claim 10, wherein the thermistor element comprises $Mn_3O_4$ and NiO.

12. The negative temperature coefficient thermistor according claim 1, wherein the transition metal is at least one of Mn, Ni, Co and Fe.

13. A method for manufacturing a negative temperature coefficient thermistor, comprising:

providing green ceramic sheets containing a transition metal oxide as a main component, for forming a thermistor element;

providing at least two of said green ceramic sheets having thereon a conductive paste containing a metal component other than Cu as a main component and at least one of Cu and a Cu compound as a sub-component, for forming internal electrodes;

stacking the green ceramic sheets and at least two paste-applied green ceramic sheets to form a green compact having opposed planes;

firing the green compact to obtain a fired compact; and forming a pair of external electrodes on different portions of the fired compact, wherein the firing comprises firing the green compact at a maximum temperature of about 1,000 to 1,350° C. in an atmosphere containing about 20 to 80% of oxygen and thereafter cooling the fired compact at a cooling rate of about 100 to 300° C./h.

14. The method for manufacturing a negative temperature coefficient thermistor according to claim 13, wherein the external electrodes contain a metal component other than Cu as a main component and at least one of Cu and a Cu compound as a sub-component.

15. The method for manufacturing a negative temperature coefficient thermistor according to claim 14, wherein the cooling comprises cooling the fired compact to about 800 to 1,100° C. and holding the resulting compact at about 800 to 1,100° C. or about 60 to 600 minutes before further cooling the resulting compact.

16. The method for manufacturing a negative temperature coefficient thermistor according to claim 15, wherein the paste contains about 4 to 16% Cu or Cu compound.

17. The method for manufacturing a negative temperature coefficient thermistor according to claim 16, wherein the metal component other than Cu as a main component is at least one of Ag, Pd and Pt.

18. The method for manufacturing a negative temperature coefficient thermistor according to claim 17, wherein the external electrodes formed contain a metal component other than Cu as a main component and about 4 to 16% of at least one of Cu and a Cu compound as a sub-component.

19. The method for manufacturing a negative temperature coefficient thermistor according to claim 13, wherein the cooling comprises cooling the fired compact to about 800 to 1,100° C. and holding the resulting compact at about 800 to 1,100° C. or about 60 to 600 minutes before further cooling the resulting compact.

20. The method for manufacturing a negative temperature coefficient thermistor according to claim 13, wherein the paste contains about 4 to 16% Cu or Cu compound.

* * * * *